US006685436B2

(12) United States Patent
Huang

(10) Patent No.: US 6,685,436 B2
(45) Date of Patent: Feb. 3, 2004

(54) HOLLOW BLADES FOR CEILING FANS

(76) Inventor: Yung-Chung Huang, 3F, 36-4, Shu Hsin Rd., Shu Lin City, Taipei Hsien (TW)

( * ) Notice: Subject to any disclaimer, the term of this patent is extended or adjusted under 35 U.S.C. 154(b) by 30 days.

(21) Appl. No.: 10/117,134

(22) Filed: Apr. 8, 2002

(65) Prior Publication Data

US 2003/0190234 A1 Oct. 9, 2003

(51) Int. Cl.[7] ..... F01D 29/38
(52) U.S. Cl. ..... 416/228
(58) Field of Search ..... 416/228, 232, 416/233, 236, 237, 240, 242, 132 A, 132 R, 5, 214 R, 204

(56) References Cited

U.S. PATENT DOCUMENTS 3,480,373 A * 11/1969 Talbot
4,915,588 A * 4/1990 Brackett ..... 416/189
5,338,156 A * 8/1994 Chien ..... 416/132 A
5,401,138 A * 3/1995 Mosiewicz ..... 416/226
5,630,890 A * 5/1997 Smashey et al. ..... 148/669
6,250,886 B1 * 6/2001 Immell et al. ..... 416/214 R
6,402,475 B1 * 6/2002 Chen ..... 416/223 R
6,508,627 B2 * 1/2003 Gerken et al. ..... 416/186 R

* cited by examiner

*Primary Examiner*—Edwark K. Look
*Assistant Examiner*—James M McAleenan
(74) *Attorney, Agent, or Firm*—Rosenberg, Klein & Lee

(57) ABSTRACT

A hollow blade for a ceiling fan is made from a selected material and has a hollow interior structure to result in a reduced weight for decreasing motor loading and saving electric power consumption, and saving material consumption for reducing costs.

11 Claims, 9 Drawing Sheets

HOLLOW BLADES FOR CEILING FANS

BACKGROUND OF THE INVENTION

1. Field of the Invention

The present invention relates to blades for ceiling fans and particularly to blades with a hollow interior for ceiling fans.

2. Description of the Prior Art

Conventional ceiling fans generally have solid blades made from plywood or woods. As the blades are solid after finished, they are heavy and require a greater motor power to drive when initially activated for rotation. Blades of reduced weight require less motor power and also can save electricity consumption.

SUMMARY OF THE INVENTION

Therefore the primary object of the present invention is to resolve aforesaid disadvantages. The present invention provides hollow blades for ceiling fans to reduce weight and has built in reinforced means to increase the strength of the blades.

The foregoing, as well as additional objects, features and advantages of the present invention will be more readily apparent from the following detailed description, which proceeds with reference to the accompanying drawings.

DESCRIPTION OF THE PREFERRED EMBODIMENTS

Figure 1A:
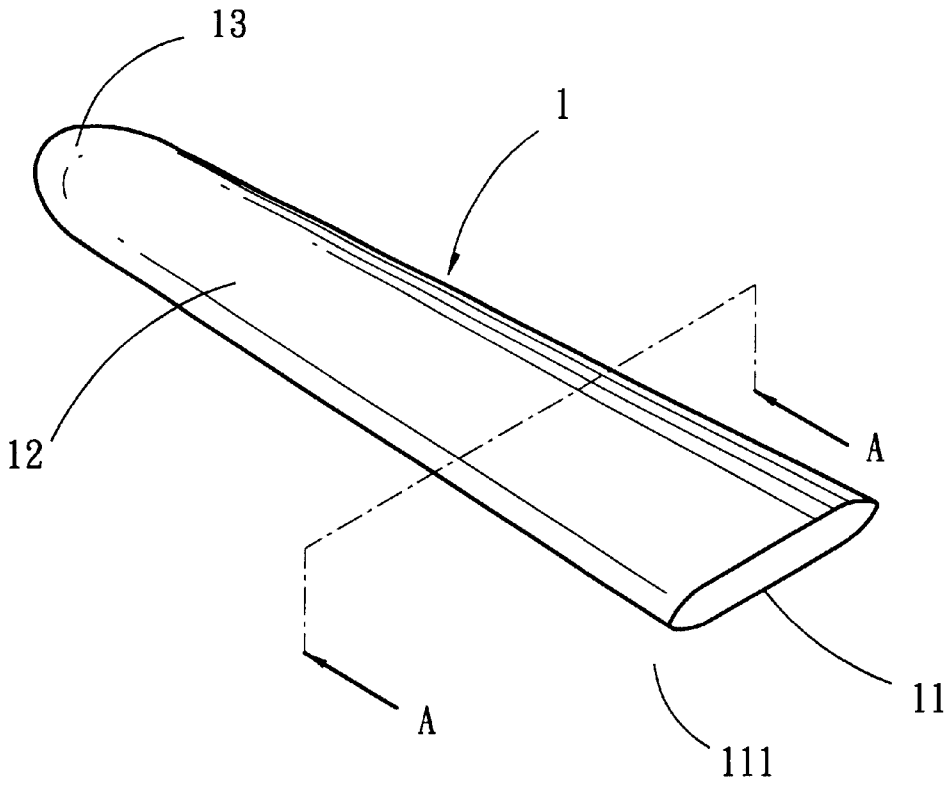
FIG. 1A is a perspective view of a first embodiment of the invention.
Figure 1B:
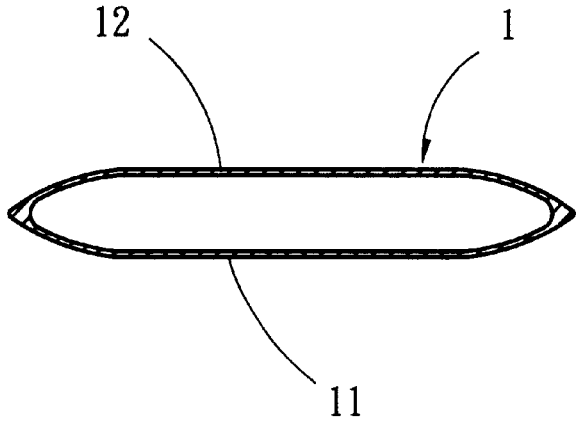
FIG. 1B is a cross section taken along line A—A in FIG. 1A.

Refer to FIGS. 1A and 1B for a first embodiment of the invention. The hollow blade 1 for ceiling fans according to the invention is made from a selected material and is formed with a hollow interior structure and a desired shape. The blade 1 has a tangent surface 11 and a supporting surface 12 opposing to the tangent surface 11 and a fastening section 13 for fastening to a ceiling fan (not shown in the drawings). When the blade 1 is mounted and assembled to the ceiling fan (not shown in the drawings), as the blade 1 is hollow and has a lighter weight, loading on the motor is decreased, hence electric power consumption also is reduced. Moreover, the hollow structure of the blade 1 consumes less material than conventional solid blades and also saves material costs.

Figure 2A:
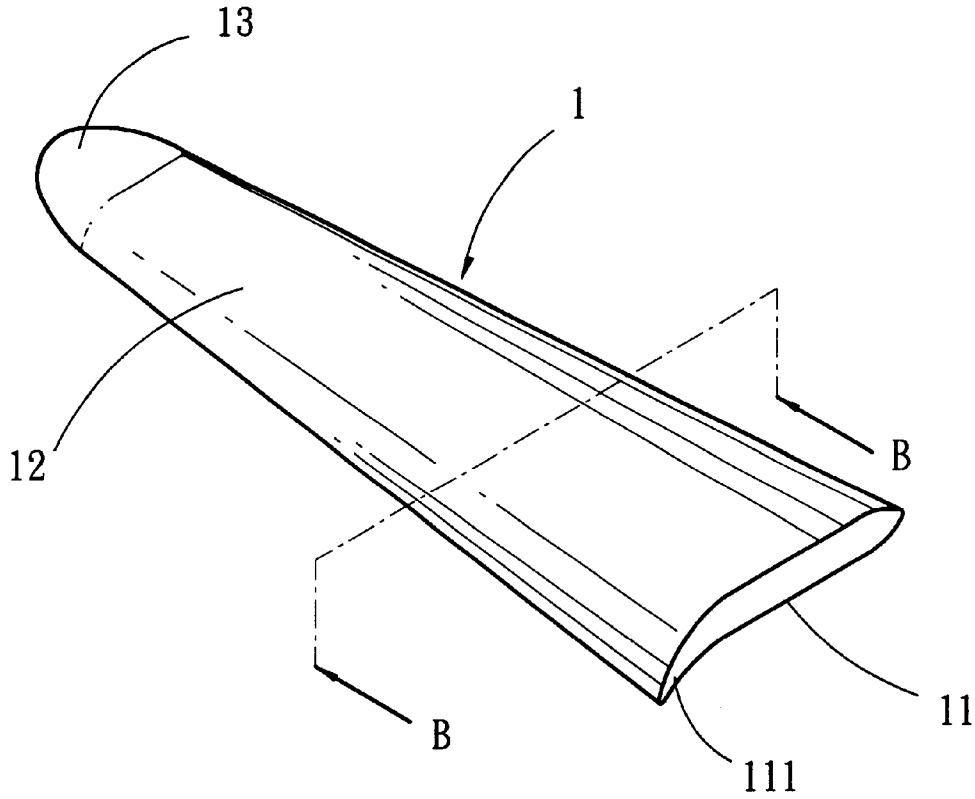
FIG. 2A is a perspective view of a second embodiment of the invention.
Figure 2B:
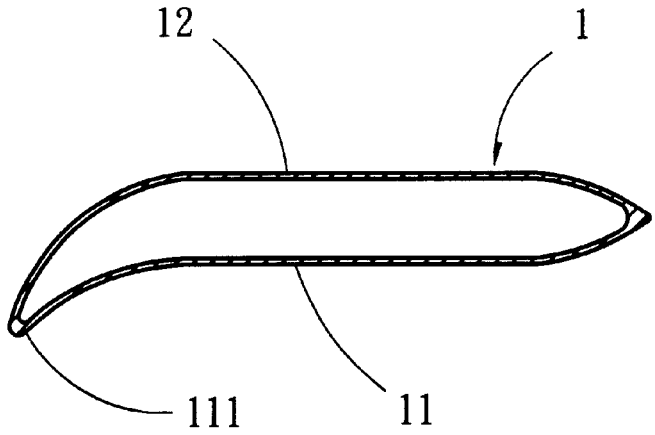
FIG. 2B is a cross section taken along line B—B in FIG. 2A.
Figure 3A:
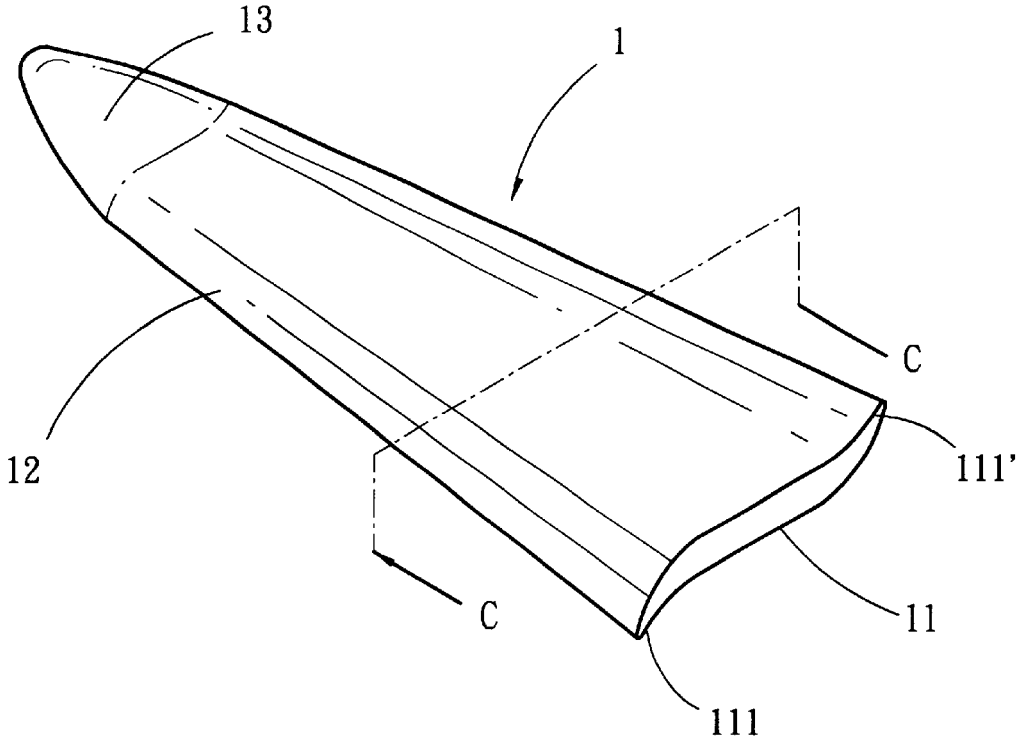
FIG. 3A is a perspective view of a third embodiment of the invention.
Figure 3B:
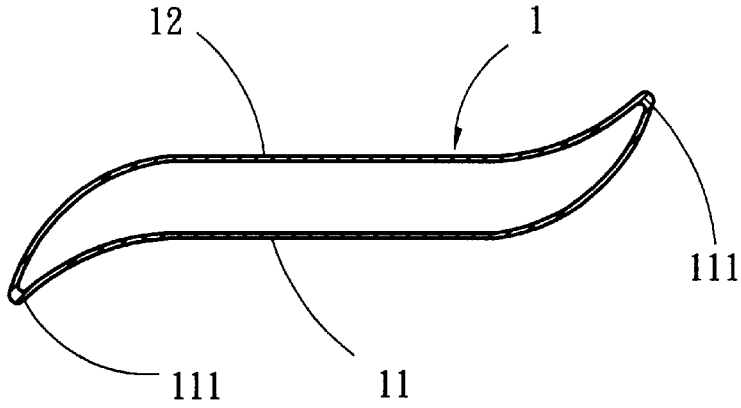
FIG. 3B is a cross section taken along line C—C in FIG. 3A.

Refer to FIGS. 2A and 2B for a second embodiment of the invention. The blade 1 has a pilot edge 111 formed on the tail end of the tangent surface 11 for channeling wind direction. Refer to FIGS. 3A and 3B for a third embodiment of the invention. The blade 1 has a pilot edge 111 formed on the tail end of the tangent surface 11 and another pilot edge 111' formed on the head end of the tangent surface 11, thus the blade 1 may channel wind direction when the ceiling fan motor rotates in either positive or reverse direction.

Figures 4A, 4B:
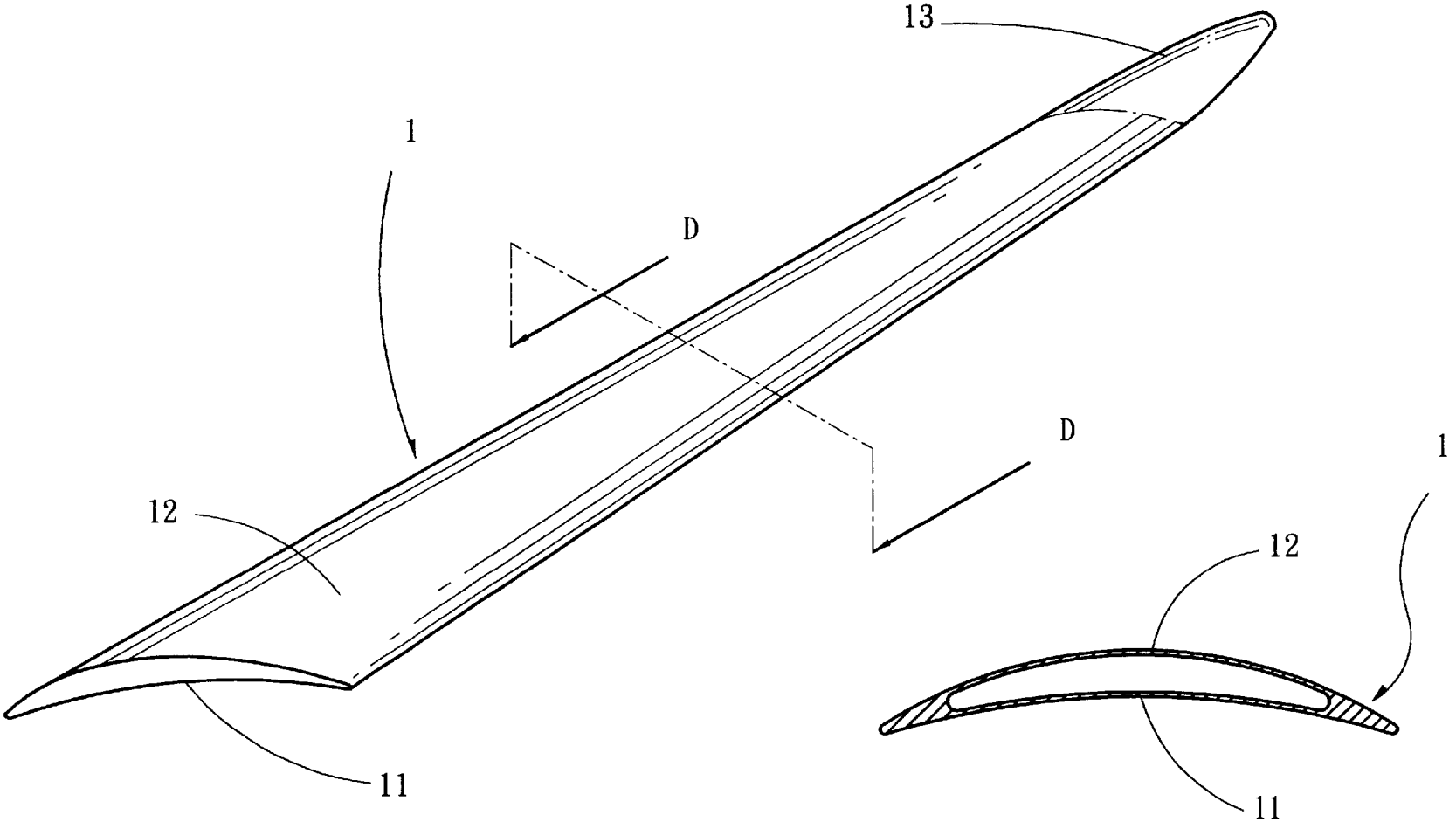
FIG. 4A is a perspective view of a fourth embodiment of the invention.
FIG. 4B is a cross section taken along line D—D in FIG. 4A.
Figure 4C:
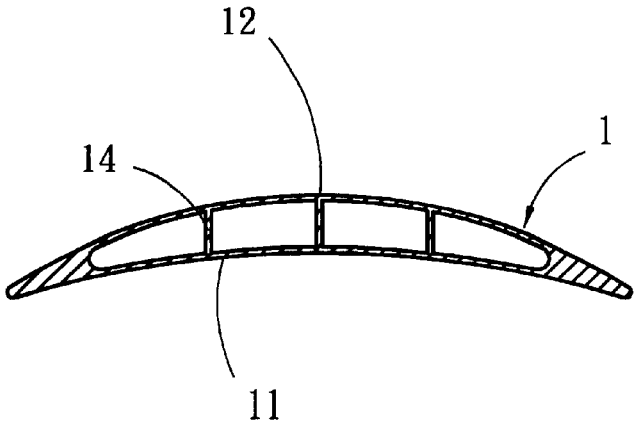
FIG. 4C is a cross section of another embodiment according to FIG. 4B.

Refer FIGS. 4A and 4B for a fourth embodiment of the invention. The tangent surface 11 and the supporting surface 12 are formed with selected curvatures for channeling wind direction. Refer to FIG. 4C for an embodiment variation according to FIG. 4B. As the blade 1 is hollow, and the tangent surface 11 requires a certain strength to withstand wind pressure without incurring deformation, and the supporting surface 12 provides the tangent surface 11 a supporting tension force. The supporting surface 12 has limited tension force and the curvature center of the arched tangent surface 11 subjects to the greatest pressure. As a result, the blade tends to incur deformation when the tangent surface 11 is under wind pressure. Hence in this embodiment, a plurality of reinforced ribs 14 are formed in the hollow space to bridge the tangent surface 11 and the supporting surface 12. Such a structure not only enables the tangent surface 11 to withstand force without deformation, can also disturb air and channel wind direction.

Figure 4D:
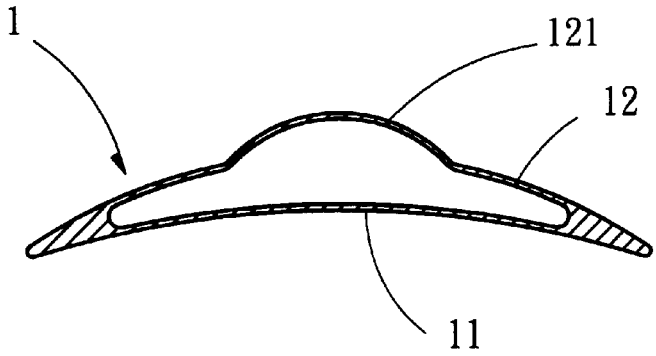
FIG. 4D is a cross section of a further embodiment according to FIG. 4B.
Figure 4E:
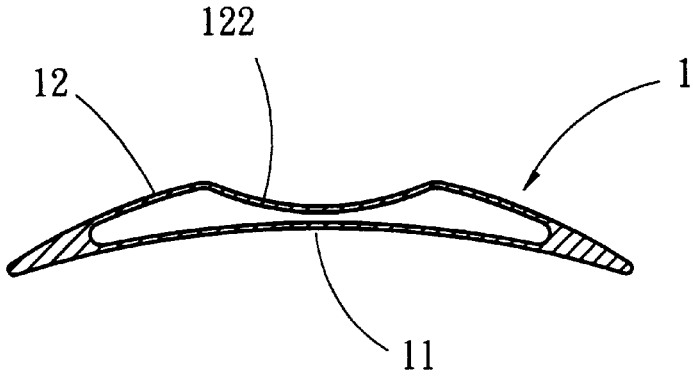
FIG. 4E is a cross section of yet another embodiment according to FIG. 4B.

Refer to FIG. 4D for another embodiment variation according to FIG. 4B. In order to increase the supporting tension force of the supporting surface 12, the supporting surface 12 has a humped ridge 121 formed on a selected location (preferably in the center of the supporting surface). Such a structure can increase the rigidity of the supporting surface 12. The humped ridge 121 may also be formed in a reverse fashion to become a concave arched surface 122 as shown in FIG. 4E. It can function equally well for increasing the rigidity of the supporting surface 12.

Figure 4F:
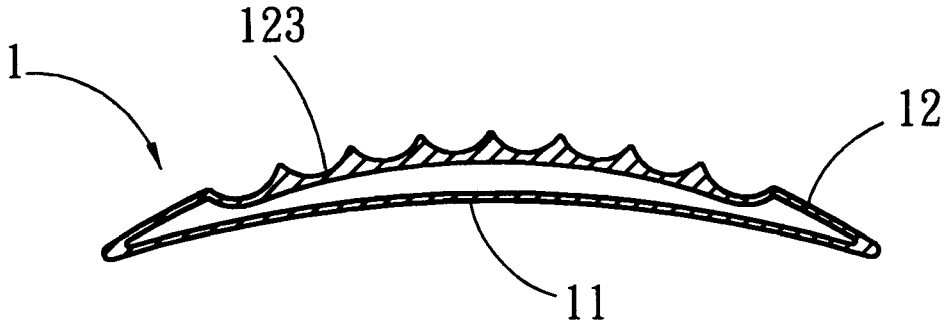
FIG. 4F is a cross section of still another embodiment according to FIG. 4B.
Figure 4G:
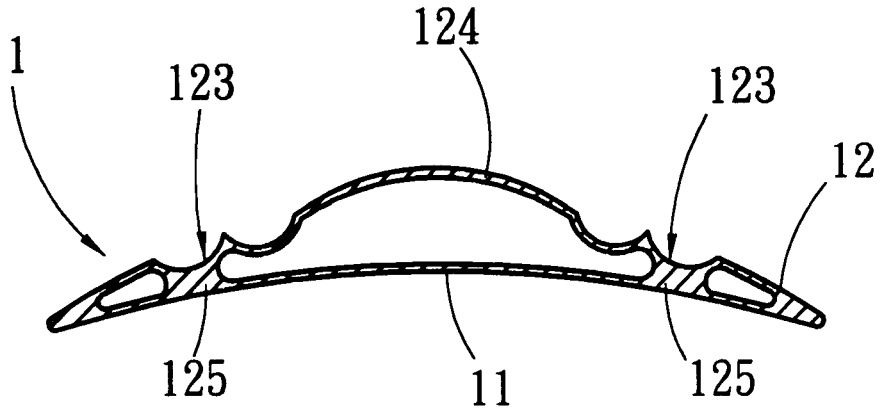
FIG. 4G is a cross section of yet another embodiment according to FIG. 4B.

Refer to FIG. 4F for yet another embodiment variation according to FIG. 4B. In order to increase the supporting tension force of the supporting surface 12, the supporting surface 12 has a plurality of indented sections 123 connecting with one another or formed in an equally spaced manner (may also be formed in a convex fashion, not shown in the drawing). This embodiment may also be altered as shown in FIG. 4G in which a convex section 124 is formed on a selected location inverse to the indented sections 123, and rib sections 125 are formed in the hollow space on desired locations to bridge the supporting surface 12 and the tangent surface 11. The indented sections 123 and convex section 124 can increase the rigidity of the supporting surface 12, and the rib sections 125 can enhance the supporting strength.

Figure 5A:
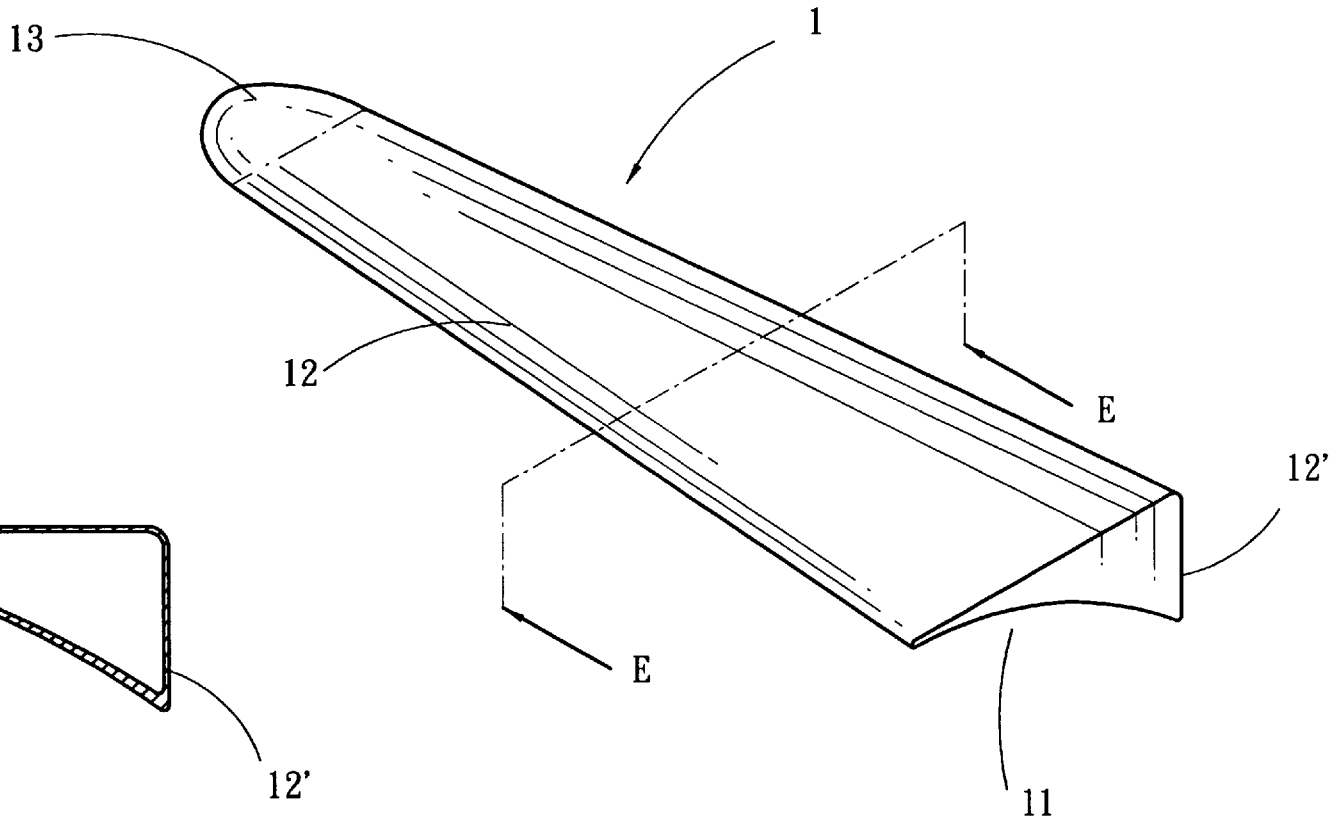
FIG. 5A is a perspective view of a fifth embodiment of the invention.
Figure 5B:
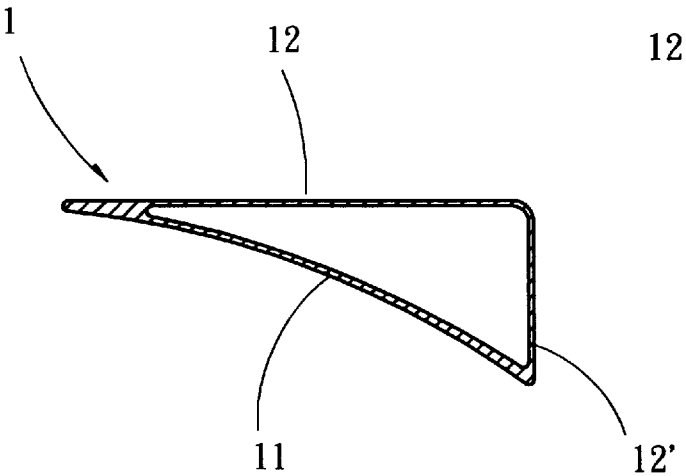
FIG. 5B is a cross section taken along line E—E in FIG. 5A.
Figure 6A:
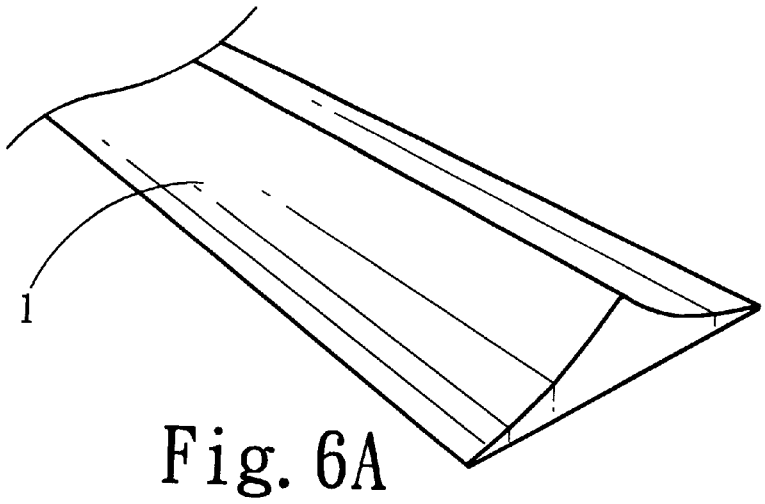
FIG. 6A is a schematic view of another embodiment according to FIG. 5A.
Figure 6B:
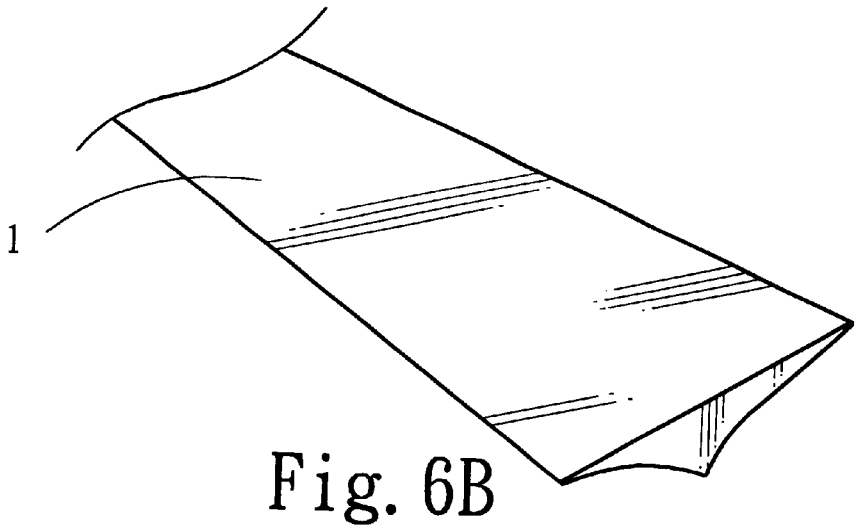
FIG. 6B is a schematic view of yet another embodiment according to FIG. 5A.
Figure 6C:
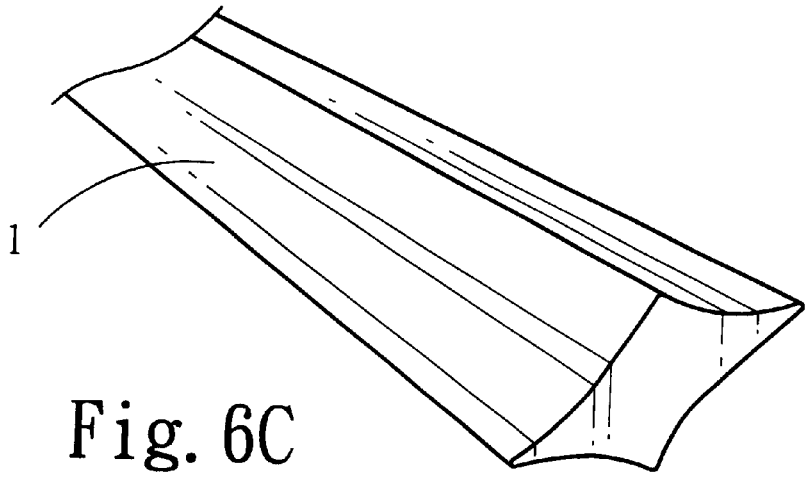
FIG. 6C is a schematic view of still another embodiment according to FIG. 5A.

Refer FIGS. 5A and 5B for a fifth embodiment of the invention. The blade 1 has substantially a triangular cross section. The triangular cross section has a longer side neighboring to a shorter side to respectively form supporting surfaces 12 and 12', while the diagonal side becomes the tangent surface 11 and has a selected curvature. FIGS. 6A, 6B and 6C are embodiment variations according to FIG. 5A. The triangular cross section of the blade 1 may be altered to various shapes according to requirements. Four sets of the blade 1 of the same shape may be assembled on a ceiling fan. When rotated, the blades can direct wind downwards, or upwards to increase air convection. The blade may also be formed in a diamond shape so that whether the motor is rotated in the positive direction or reverse direction, equal effect can be generated.

Figures 7A, 7B:
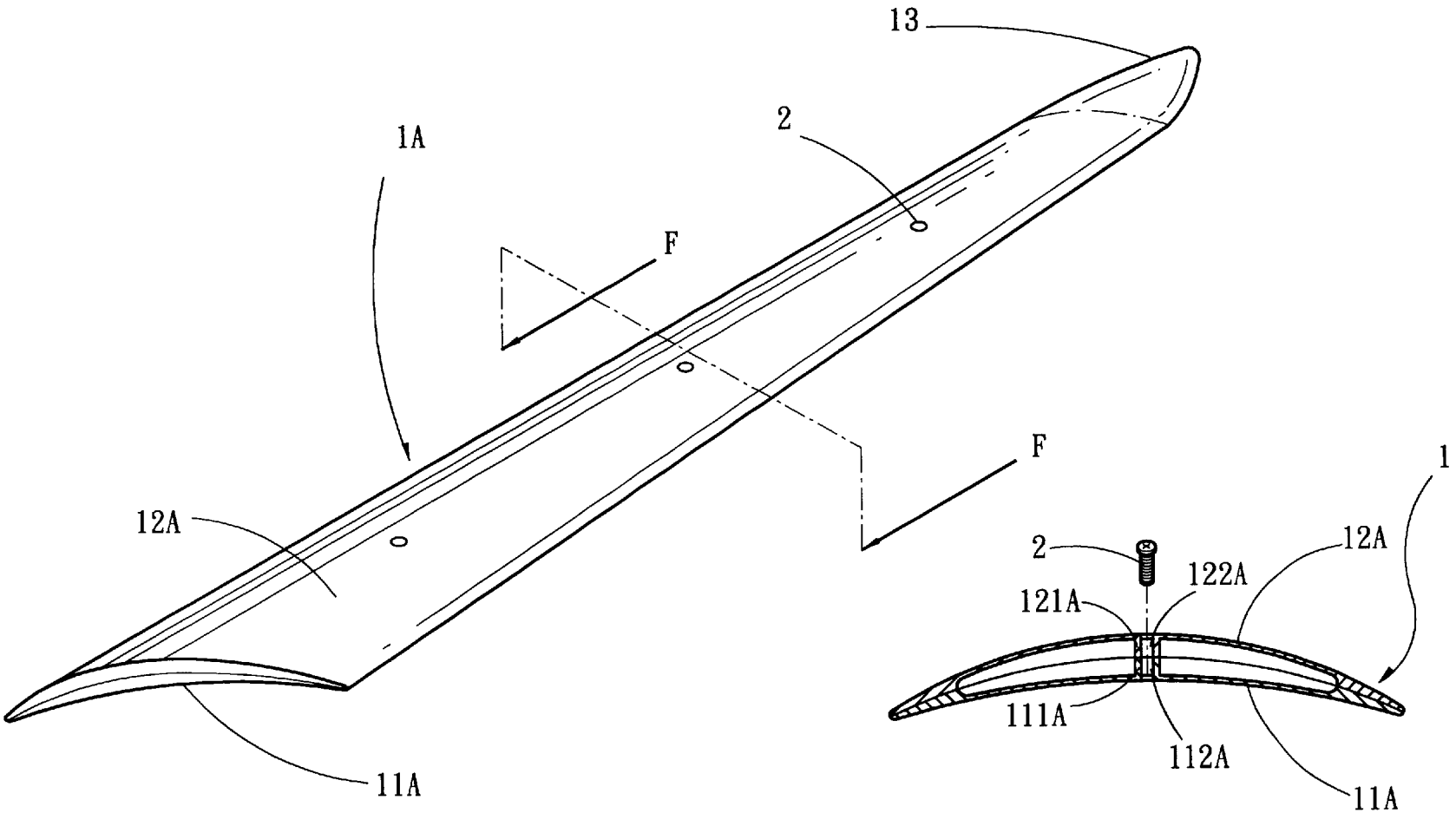
FIG. 7A is a perspective view of a sixth embodiment of the invention.
FIG. 7B is a cross section taken along line F—F in FIG. 7A.

Refer FIGS. 7A and 7B for a sixth embodiment of the invention. The blade 1A has a tangent blade 11A and a supporting blade 12A to form a hollow interior structure. In the hollow space, there are two reinforced ribs 111A and 121A bridging the tangent blade 111A and the supporting blade 12A. In the reinforced ribs 111A and 121A, there are screw holes 112A and 122A. When the tangent blade 11A and the supporting blade 12A are assembled, screws 2 or other fastening elements may be employed to fasten or anchor the tangent blade 11A and the supporting blade 12A together to prevent the two from breaking away and to mount to the ceiling fan securely.

While the preferred embodiments of the invention have been set forth for the purpose of disclosure, modifications of the disclosed embodiments of the invention as well as other embodiments thereof may occur to those skilled in the art. And the disclosed embodiments are served for reference and illustrative purposes, and are not intended to limit the scope of the invention. The hollow blades of the invention are especially desirable for ceiling fans of slow rotation and driven by small motors, and the blades may be formed in various shapes desired, such as animal figures, knifes, air crafts, or the likes. Accordingly, the appended claims are intended to cover all embodiments which do not depart from the spirit and scope of the invention.

What is claimed is:

1. A hollow blade for a ceiling fan having a hollow interior structure comprising a tangent surface and a supporting surface opposing the tangent surface, and a fastening section for fastening to the ceiling fan, said supporting and tangent surfaces having substantially parallel planar surface portions, the supporting and tangent surfaces converging at opposed head and tail ends each defining a pilot edge, the head and tail end pilot edges being opposed in orientation for reversible configuration of the hollow blade.

2. The hollow blade of claim 1, wherein the hollow interior has reinforced ribs located therein for bridging the tangent surface and the supporting surface.

3. The hollow blade of claim 1, wherein the supporting surface has a humped ridge formed on a portion thereof.

4. The hollow blade of claim 3, wherein the humped ridge is formed at a center of the supporting surface.

5. The hollow blade of claim 1, wherein the supporting surface has a concave arched surface formed on a portion thereof.

6. The hollow blade of claim 5, wherein the concave arched surface is formed at a center of the supporting surface.

7. A hollow blade for a ceiling fan having a hollow interior structure comprising a tangent surface and a supporting surface opposing the tangent surface, and a fastening section for fastening to the ceiling fan;

wherein the supporting surface has indented sections connected with one another or formed in an equally spaced fashion.

8. The hollow blade of claim 7, wherein the indented sections include a convex section extending in an inverse direction against the indented sections.

9. The hollow blade of claim 8, wherein the supporting surface and the tangent surface are connected by a rib section extending therebetween.

10. A hollow blade for a ceiling fan having a fastening section for fastening to the ceiling fan comprising a hollow interior structure with substantially a triangular cross section, the triangular cross section having a long side and a neighboring short side forming supporting surfaces and a diagonal side to forming a tangent surface.

11. The hollow blade of claim 10, wherein the tangent surface has a curvature.

* * * * *